US006640995B2

(12) United States Patent
Jepson

(10) Patent No.: US 6,640,995 B2
(45) Date of Patent: Nov. 4, 2003

(54) CONTACT LENS DISPENSING SYSTEM

(76) Inventor: Peter Jepson, 3408 Inman Dr., Atlanta, GA (US) 30319

( * ) Notice: Subject to any disclaimer, the term of this patent is extended or adjusted under 35 U.S.C. 154(b) by 32 days.

(21) Appl. No.: 10/106,738

(22) Filed: Mar. 20, 2002

(65) Prior Publication Data

US 2002/0175177 A1 Nov. 28, 2002

Related U.S. Application Data

(60) Provisional application No. 60/279,194, filed on Mar. 27, 2001, and provisional application No. 60/311,945, filed on Aug. 13, 2001.

(51) Int. Cl.[7] ..... B65G 59/00
(52) U.S. Cl. ..... 221/131; 206/5.1
(58) Field of Search ..... 221/1, 70, 92, 221/123, 131, 124; 206/5, 5.1, 499, 526

(56) References Cited

U.S. PATENT DOCUMENTS 3,493,106 A * 2/1970 Galli ..... 206/497

* cited by examiner

*Primary Examiner*—Kenneth W. Noland
(74) *Attorney, Agent, or Firm*—Richard I. Gearhart; R. Scott Meece

(57) ABSTRACT

A contact lens dispensing unit includes a left upright member and a right upright member. Each upright member has a top end and an opposite bottom end and defines a channel therein that is capable of receiving therein a stacked plurality of prepackaged contact lenses. Each upright member also defines an opening through which a prepackaged contact lens may pass. An attachment device that facilitates securing the dispensing unit to a wall is coupled to the back. In a packaging system for contact lenses, a plurality of sterile sealed contact lens packets, each holding a contact lens, is disposed in a row. Each packet in the row is joined to at least one adjacent packet and is separated by a serration.

12 Claims, 2 Drawing Sheets

CONTACT LENS DISPENSING SYSTEM

CROSS REFERENCE TO A PROVISIONAL APPLICATION

This patent application claims priority on Provisional Application Ser. Nos. 60/279,194, filed on Mar. 27, 2001, and 60/311,945 filed Aug. 13, 2001 the entirety of which are hereby incorporated by reference.

BACKGROUND OF THE INVENTION

1. Field of the Invention

The present invention relates to dispensing units and, more specifically, to a dispensing unit for contact lenses.

2. Description of the Prior Art

Disposable contact lenses come in a variety of packaging types. One type is the individual packet in which each contact lens is packaged in its own disposable sterile packet. Typically, the packet is made of a vacuum-formed cup with a fused plastic lid sealing the lens in the cup. Another type of disposable packed is an envelope made of two fused plastic sheets.

One problem with individual packets is that the user must be careful to ensure that the correct lens is placed in the correct eye. If the user is hurried, a left eye lens might be inadvertently placed in the user's right eye.

Therefore, there is a need for a contact lens dispensing system that facilitates placing a contact lens in the correct eye.

SUMMARY OF THE INVENTION

The disadvantages of the prior art are overcome by the present invention which, in one aspect, is a contact lens dispensing unit having a top, an opposite bottom, a front and an opposite back. A left upright member has a left top end and an opposite left bottom end, the left upright member defines a left channel therein that is capable of receiving therein a stacked plurality of prepackaged contact lenses. The left upright member also defines a left opening, adjacent the front and the left bottom end, through which a prepackaged contact lens may pass. A right upright member has a right top end and an opposite right bottom end. The right upright member defines a right channel therein that is capable of receiving therein a stacked plurality of prepackaged contact lenses. The right upright member also defines a right opening, adjacent the front and right bottom end, through which a prepackaged contact lens may pass. The right upright member is adjacent to the left upright member so that when viewed from the front, the right upright member is to the right of the left upright member. An attachment device, coupled to the back, facilitates securing the dispensing unit to a wall.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
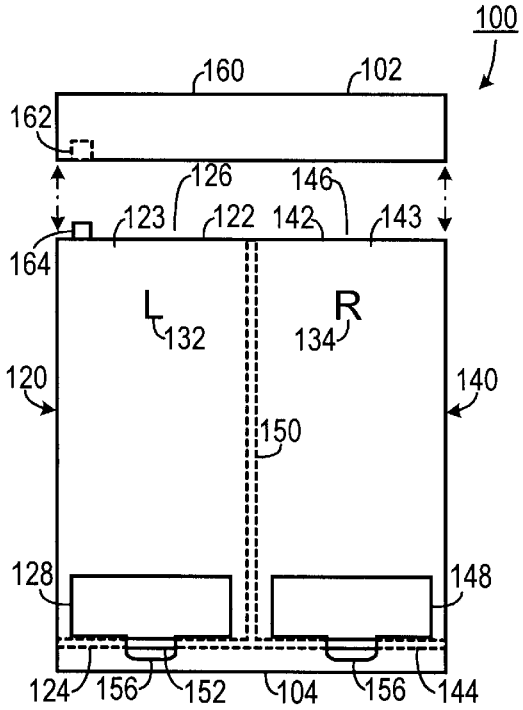
FIG. 1 is a front view of one illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, as used herein "serration" means any manipulation of a sheet that facilitates easy tearing along a predetermined path, and includes a plurality of closely spaced holes defined along the path, a groove cut into the sheet along the path and a weakening of the sheet along the path.

Figure 2:
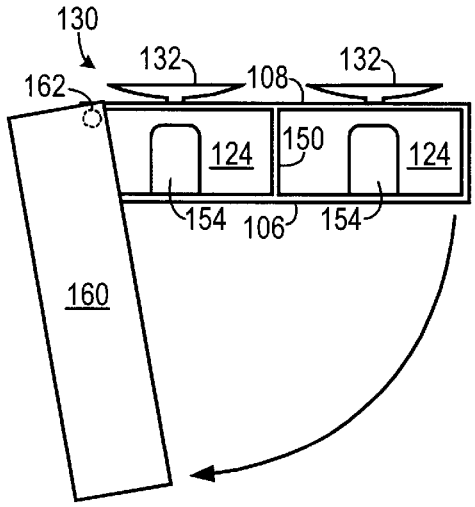
FIG.2 is a top view of the embodiment shown in FIG. 1.
Figure 3:
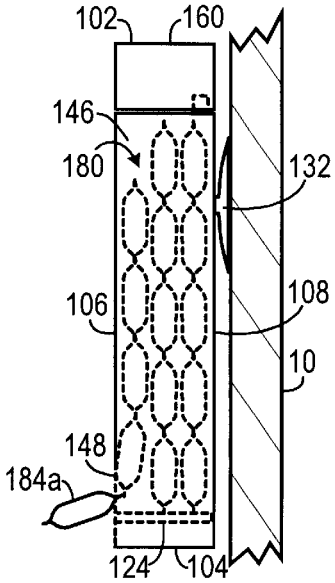
FIG. 3 is a right side view of the embodiment shown in FIG. 1.
Figure 4A:
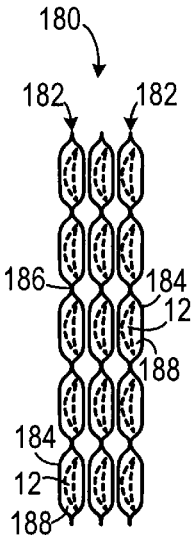
FIG. 4A is a side view of a plurality of rows of contact lens packets according to the invention.
Figure 4B:
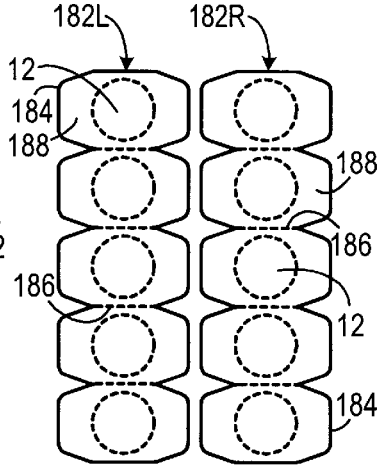
FIG. 4B is a front view of the plurality of rows of contact lens packets shown in FIG. 4A.

As shown in FIGS. 1, 2 and 3, one embodiment of the invention is a contact lens dispensing unit 100 having a top 102, an opposite bottom 104, a front 106 and an opposite back 108. A left upright member 120 has a left top end 122 and an opposite left bottom end 124. The left upright member 120 defines a left channel 126 therein that is capable of receiving therein a stacked plurality of prepackaged contact lenses. The left upright member 120 also defines a left opening 128, adjacent the front 106 and the left bottom end 124, through which a prepackaged contact lens may pass. A right upright member 140 has a right top end 142 and an opposite right bottom end 144. The right upright member 140 defines a right channel 146 therein that is also capable of receiving therein a stacked plurality of prepackaged contact lenses. The right upright member 140 also defines a right opening 148, adjacent the front 106 and right bottom end 144, through which a prepackaged contact lens may pass. The right upright member 140 is adjacent to, and to the right of the left upright member 120 and the two are separated by an upright divider 150.

At the bottom ends 124 and 144 of the channels 126 and 146 a floor 152 supports the contact lenses placed in the channels 126 and 146. A tab 154 may be cut out of the floor 152 to facilitate the easy removal of a contact lens from the dispensing unit 100.

The left top end 122 defines a left open entrance 123 to the left channel 126 and the right top end 142 defines a right open entrance 143 to the right channel 146. The dispensing unit 100 includes a lid portion 160 that is hingedly attached to the top of the dispensing unit 100 so as to selectively cover or expose the right open entrance 143 and the left open entrance 123. The lid 160 may pivot about a pin 164 that fits into a complementary recess 162, the two of which together act as a hinge. Thus, to add contact lenses, the user swings the lid 160 open, as shown in FIG. 2, and places the new lenses into the channels 126 and 146.

The left upright member 120 may be embossed with indicia 132 (such as the letter "L") to signify that left eye contact lenses are in the left channel 126. Similarly, the right upright member 140 may be embossed with indicia 134 (such as the letter "R") to signify that right eye contact lenses are in the right channel 146.

An attachment device 130 is coupled to the back 108 and facilitates securing the dispensing unit to a wall 10. The attachment device 132 could be embodied as one or more suction cups 132. The attachment device 130 could also be embodied as a hook and loop fastener, a piece of two-sided tape, a screw or one of the many types of attachment devices generally known in the art. Typically, the user will attach the dispensing unit 100 to a wall near a sink so as to facilitate convenient access to contact lenses at a location where the user is likely to apply the lenses.

In the packaging system 180 for contact lenses 12, according to the invention, a plurality of sterile sealed contact lens packets 184 is disposed in a row 182. Each packet 184 defines a cavity 188 therein and the packets 184 are joined at junctions 186, each of which includes a serration to facilitate easy separation of two adjacent packets. Each of the rows 182 includes only right side contact lenses (e.g., right row 182R) or left side contact lenses (e.g., left row 182L). Thus, the user places one or more left rows 182L of lens packets in the left channel 126 and one or more rows right rows 182R in the right channel 146. When application of the lenses 12 is performed, the user removes a packet 184*a* from the opening 148 (when a right side lens is required, or 128 when a left side lens is required), opens the packet 184*a* and applies the lense 12.

Thus, the invention allows one to dispense contact lenses, such as disposable contact lenses, so that the left lens is intuitively on the left side and the right lens is intuitively on the right side. This increases convenient access to the lenses and makes placement of a lens in the correct eye a simple matter.

Figure 5:
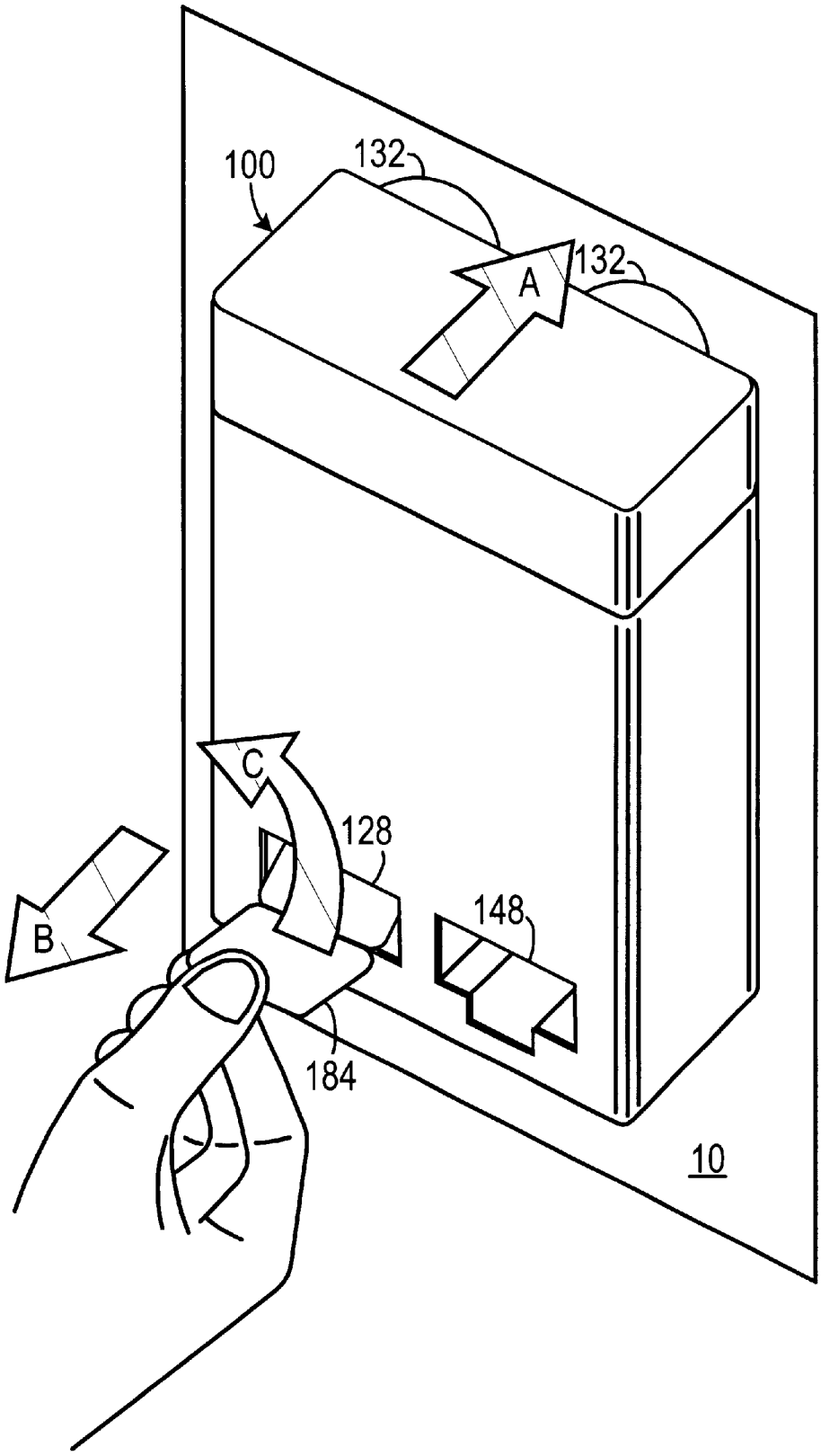
FIG. 5 is a top front perspective view of one embodiment of the invention while in use.

As shown in FIG. 5, a user installs the dispensing unit 100 by pushing it against a wall 10 in direction A to engage the suction cups 132 with the surface of the wall 10. To remove a contact lens packet 184 from the dispensing unit 100, the user first pulls the packet 184 out in direction B. Once the packet is out of the opening 128, the user tears the packet 184 away from the adjacent packet using a rotational motion, such as in direction C.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A contact lens dispensing unit having a top, an opposite bottom, a front and an opposite back, comprising:

a. a left upright member having a left top end and an opposite left bottom end, the left upright member defining a left channel therein that is capable of receiving therein a stacked plurality of prepackaged contact lenses, the left upright member also defining a left opening, adjacent the front and the left bottom end, through which a prepackaged contact lens may pass;

b. a right upright member having a right top end and an opposite right bottom end, the right upright member defining a right channel therein that is capable of receiving therein a stacked plurality of prepackaged contact lenses, the right upright member also defining a right opening, adjacent the front and right bottom end, through which a prepackaged contact lens may pass, the right upright member being adjacent to the left upright member so that when viewed from the front, the right upright member is to the right of the left upright member; and C. an attachment device, coupled to the back, that is capable of securing the dispensing unit to a wall.

2. The contact lens dispensing unit of claim 1, wherein the attachment device comprises at least one suction cup.

3. The contact lens dispensing unit of claim 1, wherein the left top end defines a left open entrance to the left channel and wherein the right top end defines a right open entrance to the right channel, the dispensing unit further comprising a lid portion that is hingedly attached to either the left top end or the right top end of the dispensing unit so as to selectively cover or expose the right open entrance and the left open entrance.

4. The contact lens dispensing unit of claim 1, wherein the left upright member and the right upright member comprises two portions of a single unit that has been formed by an injection molding process.

5. A contact lens dispensing unit having a top, an opposite bottom, a front and an opposite back, comprising:

a. an elongated container having a front wall and an opposite back wall, defining a chamber therein, the front wall defining a left opening and a spaced-apart right opening, the left opening and the right opening each having a size sufficient to allow a contact lens package to pass therethrough;

b. an upright divider wall disposed within the chamber so as to divide the chamber into a left channel, opening to the left opening, and a right channel, opening to the right opening; and c. a latitudinal floor, disposed adjacent the bottom of the elongated container, that is capable of supporting a plurality of contact lens packages.

6. The contact lens dispensing unit of claim 5, further comprising an attachment device for securing the dispensing unit to a wall.

7. The contact lens dispensing unit of claim 6 wherein the attachment device comprises at least one suction cup affixed so as to extend outwardly from the back wall of the container.

8. The contact lens dispensing unit of claim 5, wherein the dispensing unit includes a left top end and an opposite right top end, the dispensing unit further comprising a lid portion that is hingedly attached to either the left top end or the right top end of the dispensing unit so as to selectively cover or expose the left channel and the right channel.

9. A method of dispensing contact lenses, comprising the steps of:

a. packaging a plurality of left-eye contact lenses in a corresponding plurality of left disposable sealed packets so that each left disposable sealed packet contains a single contact lens that is adapted for use in a user's left eye;

b. packaging a plurality of right-eye contact lenses in a corresponding plurality of right disposable sealed packets so that each right disposable sealed packet contains a single contact lens that is adapted for use in the user's right eye;

c. disposing the plurality of left disposable sealed packets in a left channel defined by a container; and d. disposing the plurality of right disposable sealed packets in a right channel defined by the container.

10. The method of dispensing contact lenses of claim 9, further comprising the step of affixing an attachment device to the container to facilitate securing the container to a wall.

11. The method of dispensing contact lenses of claim 10, wherein the affixing step further comprises the step of affixing a suction cup to the container.

12. The method of dispensing contact lenses of claim 9, further comprising the step of placing the container at a place where the user is able to remove single left disposable packets and right disposable packets from the container.

* * * * *